United States Patent [19]

Nalesnik

[11] Patent Number: 4,990,274

[45] Date of Patent: Feb. 5, 1991

[54] FLOWABLE GRAFT AND DERIVATIZED POLYMER CONCENTRATE AND LUBRICANT CONTAINING SAME

[75] Inventor: Theodore E. Nalesnik, Beacon, N.Y.

[73] Assignee: Texaco Inc., White Plains, N.Y.

[21] Appl. No.: 273,540

[22] Filed: Nov. 21, 1988

[51] Int. Cl.[5] ..... C10M 129/16; C10M 129/72

[52] U.S. Cl. ..... 252/52 A; 252/52 R; 252/56 R

[58] Field of Search ..... 252/52 R, 52 A, 56 R

[56] References Cited

U.S. PATENT DOCUMENTS

| | | | |
|---|---|---|---|
| 3,871,837 | 3/1975 | Bedagne | 252/52 A |
| 4,479,882 | 10/1984 | Zoleski | 252/52 A |
| 4,693,838 | 9/1987 | Varma | 252/51.5 R |
| 4,707,285 | 11/1987 | Brewster | 250/50 |

FOREIGN PATENT DOCUMENTS

| | | | |
|---|---|---|---|
| 2246598 | 4/1973 | Fed. Rep. of Germany | 252/52 A |
| 0015489 | 1/1984 | Japan | 252/52 A |
| 2121818 | 1/1984 | United Kingdom | 252/52 A |
| 2124650 | 2/1984 | United Kingdom | 252/52 A |

*Primary Examiner*—Olik Chaudhuri
*Assistant Examiner*—Ellen McAvoy
*Attorney, Agent, or Firm*—Robert A. Kulason; James J. O'Loughlin

[57] ABSTRACT

An oil additive concentrate comprising (1) a mixture of a graft and derivatized polymer and a mineral oil of lubricating viscosity said mixture characterized by comprising from about 5 to 35 weight percent of said polymer and the balance said mineral oil and having a bulk viscosity measured as the Kinematic Viscosity at 100° C. above about 2000 Centistokes, and (2) a minor amount of a co-solvent effective for substantially reducing the bulk viscosity of said mixture, said co-solvent being selected from the group represented by the formulas:

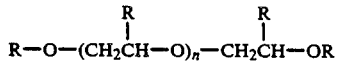

(a)

in which R represents hydrogen and a hydrocarbyl radical having from 1 to 25 carbon atoms and n has a value from 0 to 10, and

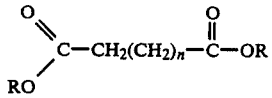

(b)

in which R represents a hydrocarbyl radical having from 1 to 12 carbon atoms and n has a value from 0 to 10, and a lubricating oil composition containing same is provided.

14 Claims, No Drawings

FLOWABLE GRAFT AND DERIVATIZED POLYMER CONCENTRATE AND LUBRICANT CONTAINING SAME

FIELD OF THE INVENTION

This invention relates to a multi-functional graft and derivatized polymeric additive composition which is useful as a dispersant, viscosity index improver and anti-oxidant in lubricating oils. More particularly, the invention relates to flowable concentrates of the multi-functional polymeric additive and to a method for their preparation.

BACKGROUND OF THE INVENTION

Multi-functional graft and derivatized polymers or copolymers for lubricating oil compositions are well known. In general, a hydrocarbon solution of a polymer substrate, as for example a copolymer, terpolymer or higher polymer base, is reacted with an olefinic carboxylic material in a graft reaction to prepare a grafted polymer. This is then further functionalized by a reaction with a variety of compounds to produce an oil concentrate of the multi-functional polymeric additive. The oil concentrate will generally contain from about 5 to 35 weight percent of the multi-functional polymeric additive based on the total weight of the mixture. Ethylene copolymers which have been grafted with maleic anhydride and then functionalized with an amine compound represent one class of multi-functional lubricant additive. Examples of grafted and derivatized multi-functional additives may be seen in U.S. Pat. No. 4,146,489 to Stambaugh et al., U.S. Pat. No. 4,114,181 to Elliott et al. and U.S. Pat. No. 4,089,794 to Engel et al.

A serious problem which has been encountered with oil concentrates of certain high molecular weight grafted and derivatized polymers and copolymers is their very high bulk viscosity. Bulk viscosities determined as the Kinetic Viscosity at 100° C. of over 2000 Centistokes have been observed relative to the identical underivatized polymer with a Kinetic Viscosity at 100° C. of less than 100 Centistokes. Some of the graft and derivatized copolymers are so viscous that their bulk viscosity cannot be measured. The high bulk viscosity of these product concentrates makes them extremely difficult to handle, process and/or transport and this is a serious drawback to their usefulness.

A method has now been found for substantially reducing the high bulk viscosity of oil concentrates of high molecular weight graft and derivatized polymers and copolymers greatly enhancing their usefulness as lubricant additives.

DISCLOSURE STATEMENT

Copending coassigned application Ser. No. 172,664 discloses graft and derivatized copolymers and lubricating oil compositions containing same.

U.S. Pat. No. 4,707,285 discloses haze-free graft and derivatized ethylene-propylene copolymers for lubricants.

U.S. Pat. No. 4,693,838 discloses multi-functional viscosity index improvers for lubricants.

The disclosures of Ser. No. 172,664 and of U.S. Pat. Nos. 4,707,285 and 4,693,838 are incorporated herein by reference.

SUMMARY OF THE INVENTION

In accordance with this invention, it has been found that the bulk viscosity of oil concentrates of grafted and derivatized polymers/copolymers, which are generally characterized by bulk viscosities of over 2000 Centistokes at 100° C., can be substantially reduced by mixing a minor amount of a prescribed co-solvent with the oil concentrate of the grafted and derivatized polymer. More specifically, a minor amount of a co-solvent from the class comprising alkyl or alkaryl ethylene glycol ethers or ether alcohols and esters of diacids are effective for reducing the bulk viscosities of oil concentrates of grafted and derivatized polymers/copolymers. The co-solvent may be added directly to the finished oil concentrate of the graft and derivatized polymers/-copolymers or it may be employed together with the amine used in the derivatization reaction, that is in the final step of the preparation of the grafted and derivatized polymer/copolymer.

DETAILED DESCRIPTION OF THE INVENTION

The graft and derivatized polymer or copolymer may be prepared from a variety of polymer or copolymer substrates. A typical substrate can be prepared from ethylene and propylene or it can be prepared from ethylene and a higher olefin within the range of $C_3$ to $C_{10}$ alpha-monoolefins. More complex polymer substrates, often designated as interpolymers, may be prepared using three or more olefin components to prepare the substrate. In general, a conventional polymerization reaction is employed to prepared the polymer substrate.

The substrate may be an ethylene-propylene copolymer and may consist of from 15 to 80 mole percent of ethylene and from about 20 to 85 mole percent propylene. Terpolymers and interpolymers which may be made up of three or more olefins may be employed as the polymer substrate. A typical terpolymer may contain from about 0.5 to 10 mole percent of the terpolymer component.

The polymer substrate employed in the preparation of graft and derivatized polymers for lubricating oils is an oil-soluble, substantially linear, rubbery material having a number average molecular weight ranging from about 5,000 to 500,000 or above. Preferred are polymers having a number average molecular weight ranging from about 50,000 to 200,000 with the most preferred polymers having a number average molecular weight from about 75,000 to 150,000.

The terms polymer and copolymer are used herein in a generic sense and are intended to encompass ethylene copolymers, terpolymers or interpolymers. These substrates may contain minor amounts of other components so long as their basic characteristics are not materially changed.

An ethylenic unsaturated carboxylic acid material, such as maleic anhydride, is grafted on to the polymer substrate. These materials which are attached to the polymer contain at least one ethylenic bond and at least one, preferably two, carboxylic acid or carboxylic acid anhydride groups or a polar group which is convertible into said carboxyl group by oxidation or hydrolysis. Maleic anhydride or a derivative thereof is the preferred graft material. It grafts onto the ethylene copolymer or terpolymer to give two carboxylic acid functionalities.

Grafting of the ethylenically unsaturated carboxylic acid material onto the polymer may be conducted following a number of well known processes. Grafting can be effected using the "ene" process or, alternatively, by grafting it in solution or in solid form using a free-radical initiator. The free-radical induced grafting of ethylenic unsaturated carboxylic acid onto a polymer substrate may be conducted in a hydrocarbon solution of the polymer, such as in benzene. It is carried out at an elevated temperature in the range of about 100° C. to 250° C. and more preferably, at 150° to 180° C. under an inert atmosphere. Grafting may be conducted in a mineral lubricating oil solution of the polymer.

The grafted copolymer is then reacted with an additional functional compound in a derivatization reaction to produce the multi-functional lubricant additive. The derivatization reaction may be carried out using a polyamine, a hydroxyamine, or a polyol. Particularly useful polyamines are those having from 2 to 20 carbon atoms and 2 to 5 nitrogen atoms in the molecule where only one nitrogen atom is a primary nitrogen atom and all the rest are tertiary nitrogen atoms or highly hindered secondary nitrogen atoms. The class of suitable polyamines includes: hydrocarbyl polyamines including alkyl, aryl and mixed alkaryl polyamines which may contain additional groups such as hydroxy, oxyamide and imidazoline groups, N-phenyl-phenylenediamine, N-amino alkyl morpholine.

Useful hydroxyamines are those hydroxyamines having from 2 to 20 carbon atoms, 1 to 4 hydroxy groups and 1 to 5 nitrogen atoms. Typical hydroxyamines include: diethanolamine, di-propanolamine, tris-hydroxymethyl amino-methane and 2-amino-2-ethyl-1,3-propanediol.

Useful polyols for the derivatization reaction are the polyols having from 2 to 2 carbon atoms and having from 2 to 5 hydroxyl groups. Typical polyols include: glycerol, and alkylene glycols, such as dipropylene glycol and pentaerythritol.

Certain oil concentrates of grafted and derivatized ethylene polymers which have been prepared using a relatively high molecular weight polymer substrate are characterized by having high bulk viscosities. The bulk viscosity measure referred to is the Kinematic Viscosity measured at 100° C. in Centistokes. The present discovery is especially useful for oil concentrates of grafted and derivatized polymers having bulk viscosities over 2000 Centistokes at 100° C. The value of the present discovery increases as the bulk viscosity of the grafted and derivatized polymer increases and becomes dramatically effective when employed with grafted and derivatized polymers having bulk viscosities so high that their bulk viscosity generally cannot be measured in a practical way. Oil concentrates, of grafted and derivatized polymers having bulk viscosities ranging from 2000 to 5000 or above Centistokes, and more generally, from about 3500 to 5000 Centistokes and above measured at 100° C. are contemplated in this invention. A class of grafted and derivatized polymers which benefits significantly from the present discovery are maleic anhydride grafted and derivatized ethylene copolymers having bulk viscosities ranging from 2000 to 5000 Centistokes or above.

It has been found that the high bulk viscosities of grafted and derivatized polymers may be substantially reduced and their usefulness as lubricating oil additives can be substantially improved if they are prepared as concentrates in admixture with co-solvents comprising high boiling alkyl or alkaryl ethylene glycol ethers or ether alcohols and ester of diacids described herein below.

The polymer substrates which are used in the preparation of the grafted and derivatized polymers comprising the oil concentrates employed in the instant invention will generally have a number average molecular weight ranging from about 5,000 to 500,000 or above. More often, the polymer substrates intended for use in preparing multi-functional lubricating oil additives will have a number average molecular weight from about 25,000 to 250,000. A particularly preferred class of polymer substrates are the ethylene-propylene copolymers having a number average molecular weight ranging from about 50,000 to 200,000 with a still more preferred range being from about 75,000 to 150,000.

The classes of co-solvents which are employed to produce flowable oil concentrates of high molecular weight grafted and derivatized polymers may be represented by the following general formulas:

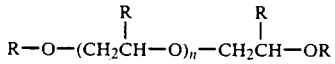

I.

in which R represents hydrogen and a hydrocarbyl radical having from 1 to 25 carbon atoms and n has a value from 0 to 10, and

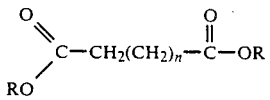

II.

in which R represents a hydrocarbyl radical having from 1 to 12 carbon atoms and n has a value from 0 to 10.

In both of the co-solvent formulas above, the hydrocarbyl radical represented by R may be an alkyl group having from 1 to 5 carbon atoms, an aryl group having from 6 to 10 carbon atoms, or an alkaryl group having from 7 to 25 carbon atoms. The preferred value for n is a number from 2 to 6.

Examples of the co-solvents represented by formula I above include the series of compounds designated a Surfonic Surface-active agents marketed by the Texaco Chemical Company. These compounds are prepared by reacting ethylene oxide with nonyl phenol to produce compounds represented by the formula: $C_9H_{19}C_6H_4O(CH_2CH_2O)_nH$ in which n has a value from 1 to 10.

Reduction in the high bulk viscosities of the oil solution of the grafted and derivatized polymers is achieved by admixing a minor amount of the prescribed co-solvent with the copolymer. In general, an oil concentrate of the grafted and derivatized polymer containing from about 5 to 25 weight percent of the grafted and derivatized polymer dissolved therein and containing from about 0.1 to 5 weight percent of the co-solvent based on the total weight of the concentrate will exhibit substantially improved flow or fluid characteristics for the concentrate mixture. A preferred amount of co-solvent in the concentrate mixture is an amount ranging from about 0.5 to 3 weight percent based on the total weight of the concentrate with the most preferred concentration of the co-solvent being an amount ranging from about 1.5 to 3 weight percent. In the method described above, a flowable concentrate is obtained by admixing an effective or suitable amount of the co-solvent into the oil concentrate of the final grafted and derivatized polymer or copolymer.

Alternatively, the flowable oil concentrate may be prepared by employing the co-solvent with the derivatizing compound prior to the reaction between the derivatizing compound and the grafted polymer. After the derivatization reaction has been completed the result will be a substantially improved flowable oil concentrate of the grafted and derivatized polymer.

The following examples illustrate the practice of this invention.

EXAMPLE I 47.0 grams of a solid maleic anhydride grafted polymer (rubber) in which the polymer substrate consisted of about 58 mole percent ethylene and 42 mole percent propylene having a number average molecular weight of about 135,000 on which had been grafted 1.1 weight percent of maleic anhydride was dissolved in 507 grams of solvent neutral mineral oil (S.U.S 100 at 100° C.) at 160° C. with mechanical stirring while the mixture was maintained under a nitrogen blanket. After the rubber polymer had dissolved, mixing was continued for an additional hour at 160° C.

1.1 grams of neat N-phenyl-1,4-phenylenediamine was added to the oil solution of the polymer and a derivatization reaction effected over 4 hours at 160° C. under nitrogen. The reaction mixture containing the derivatized graft polymer was then cooled to 100° C. and screen filtered. The polymer content of the oil-polymer concentrate mixture was 8.5 weight percent.

An attempt was made to measure the Kinematic viscosity at 100° C. of the grafted and derivatized polymer-oil concentrate but it was too viscous to measure. It was estimated to have a Kinematic viscosity at 100° C. of greater than 5000 Centistokes.

A variety of co-solvents were added, at 160° C. for 30 minutes, to the above-prepared grafted and derivatized polymer-oil concentrate. The co-solvents were blended into the concentrates by mixing at 160° C. for 30 minutes. The viscosities of the concentrate mixtures containing the cosolvent was determined and the results are set forth in Table I below.

TABLE I

Co-Solvent Effect on the Viscosity of the Oil-Polymer Mixture of Example I.

| Co-Solvent | Amount, wt. % (1) | Kin Vis @ 100° C. |
|---|---|---|
| None | — | TVTM (2) |
| Jeffox PPG 2000(a) | 1.8 | 1572 |
| Emolien 2986(b) | 2.8 | 1530 |
| Surfonic N-31.5(c) | 1.8 | 1497 |
| Surfonic N-40(d) | 1.8 | 1471 |

(1) Weight percent of co-solvent in the oil-polymer concentrate based on the total weight of the concentrate
(2) Too viscous to measure (Kin Vis @ 100° C. approx. > 5000 CSt).
(a) (poly ethylene-propylene glycol)
(b) (2-ethylhexyl diester of azelaic acid)
(c) (ethoxylated alkyl phenol)
(d) (ethoxylated alkyl phenol)

The following examples illustrate the preparation of the grafted and derivatized polymer wherein the co-solvent was employed during the derivation reaction.

EXAMPLE II 47.2 grams of a solid maleic anhydride grafted ethylene-propylene copolymer having a number average molecular weight of about 135,000 and having 1.1 weight percent maleic anhydride grafted thereon was dissolved in 507 grams of a solvent neutral base oil (SUS 100 at 100° C.) at 160° C. with stirring while being maintained under a nitrogen atmosphere. A mixture of 1.1 grams N-phenylphenylenediamine and 10 grams of Surfonic N-31.5 (ethoxylated nonylphenol with 3.15 moles of ethylene oxide per mole of nonylphenol) was prepared at 70° C. and this mixture was charged to the reactor containing the oil solution of the grafted ethylene-propylene copolymer. The derivatization reaction was conducted at 160° C. under a nitrogen atmosphere for about 2 hours. The reaction mixture was cooled to 100° C. and screen filtered through a 100 mesh screen. The bulk viscosity of the reaction mixture concentrate was measured and found to be 1495 Centistokes Kinematic Viscosity at 100° C. as compared to the bulk viscosity of the reaction product without the addition of Surfonic N-31.5 which was measured to be to viscous to measure.

EXAMPLE III 255 grams of a solid maleic anhydride-grafted ethylene-propylene copolymer having a number average molecular weight of about 135,000 and having 1.1 weight percent maleic anhydride grafted thereon was dissolved in 2745 grams of a solvent neutral base oil (SUS 100 at 100° C.) at 160° C. with stirring while being maintained under a nitrogen atmosphere. A mixture of 5.0 grams N-phenylphenylenediamine and 50 grams of Surfonic N-40 (ethoxylated nonylphenol with 4 moles of ethylene oxide per mole of nonylphenol) was prepared at 70° C. and this mixture was charged to the reactor containing the oil solution of the grafted ethylene-propylene copolymer. The derivatization reaction was conducted at 160° C. under a nitrogen atmosphere for about 2 hours. The reaction mixture was cooled at 100° C. and screen filtered through a 100 mesh screen. The bulk viscosity of the reaction mixture concentrate was measured and found to be 1229 Centistokes Kinematic Viscosity at 100° C. as compared to the bulk viscosity of the reaction product without the addition of Surfonic N-40 which was measured to be to viscous to measure.

EXAMPLE IV 72.0 grams of a solid maleic anhydride graft ethylene-propylene copolymer having a number average molecular weight of about 80,000 and having 0.85 wt. % maleic anhydride grafted thereon was dissolved in 528 grams of a solvent neutral base oil at 160° C. with stirring while being maintained under a nitrogen atmosphere. A mixture of 1.5 grams of N-phenyl-phenylenediamine and 10 grams of Surfonic N-31.5 was prepared at 70° C. and this mixture was charged to the reactor containing the oil solution of the grafted ethylene-propylene copolymer. The derivatization reaction was conducted at 160° C. under a nitrogen atmosphere for about 2 hours. The reaction mixture was cooled to 100° C. and screened filtered through a 100 mesh screen. The bulk viscosity of the reaction mixture concentrate was measured and found to be 1195 Centistokes Kinematic Viscosity at 100° C. The bulk viscosity of this reaction product without the addition of Surfonic N-31.5 was measured to be 2048 Centistokes Kinematic Viscosity at 100° C. This further illustrates the effectiveness of the co-solvent when used in the derivatization reaction.

EXAMPLE V

The oil solution of the grafted ethylene-propylene copolymer of Example IV was reacted in a derivatization reaction with a mixture of 1.5 grams of N-phenylphenylenediamine and 10 grams of Surfonic N-40. The reaction was conducted in the same manner as in Example IV. The bulk viscosity of the reaction mixture concentrate was found to be 1183 Centistokes Kinematic Viscosity at 100° C.

What is claimed:

1. An oil additive concentrate comprising:

(1) a mixture of a graft and derivatized polymer and a mineral oil of lubricating viscosity said mixture comprising from about 5 to 35 weight percent of said polymer and the balance said mineral oil and having a bulk viscosity measured as the Kinematic Viscosity at 100° C. above about 2000 Centistokes, and (2) a minor amount of co-solvent effective for substantially reducing the bulk viscosity of said mixture, said co-solvent being selected from the group represented by the formulas:

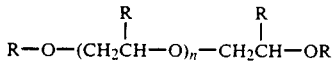

(a)

in which R represents hydrogen and a hydrocarbyl radical having from 1 to 25 carbon atoms and n has a value from 0 to 10, and

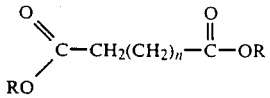

(b)

in which R represents a hydrocarbyl radical having from 1 to 12 carbon atoms and n has a value from 0 to 10.

2. An additive concentrate according to claim 1 in which said co-solvent comprises about 0.1 to 5 percent by weight based on the weight of said concentrate.

3. An additive concentrate according to claim 1 in which n is a number from 1 to 5.

4. An additive concentrate according to claim 1 in which said co-solvent comprises from about 0.5 to 3 weight percent of said concentrate.

5. An additive concentrate according to claim 3 in which n has a value from 3 to 5.

6. An concentrate according to claim 1 in which n has a value from 2 to 6.

7. A concentrate according to claim 6 in which n has a value from about 3 to 5.

8. A concentrate according to claim 6 in which said co-solvent is the additive of nonylphenol and four moles of ethylene oxide.

9. An oil additive concentrate according to claim 1 in which said graft and derivatized polymer has a number average molecular weight ranging from about 5000 to 500,000.

10. An oil additive concentrate according to claim 1 in which said graft and derivatized polymer has a number average molecular weight ranging from about 25,000 to 250,000.

11. An oil additive concentrate according to claim 1 in which said graft and derivatized polymer has a number average molecular weight ranging from about 75,000 to 150,000.

12. An oil additive concentrate according to claim 1 in which said graft and derivatized polymer is an ethylene copolymer grafted with maleic anhydride and derivatized with N-phenylphenylenediamine.

13. An oil additive concentrate according to claim 1 in which said graft and derivatized polymer is a copolymer of ethylene and propylene.

14. A lubricating oil composition comprising an oil of lubricating viscosity and a minor dispersant amount of an oil additive concentrate comprising:

(1) a mixture of a graft and derivatized polymer and a mineral oil of lubricating viscosity said mixture comprising from about 5 to 35 weight percent of said polymer and the balance said mineral oil and having a bulk viscosity measured as the Kinematic Viscosity at 100° C. above about 2000 Centistokes, and;

(2) a minor amount of co-solvent effective for substantially reducing the bulk viscosity of said mixture, said Co-solvent being selected from the group represented by the formulas:

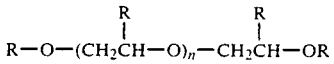

(a)

in which R represents hydrogen and a hydrocarbyl radical having from 1 to 25 carbon atoms and n has a value from 0 to 10, and

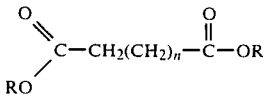

(b)

in which R represents a hydrocarbyl radical having from 1 to 12 carbon atoms and n has a value from 0 to 10.

* * * * *